US008262249B2

(12) United States Patent
Hsia et al.

(10) Patent No.: US 8,262,249 B2
(45) Date of Patent: Sep. 11, 2012

(54) LINEAR SOLID-STATE LIGHTING WITH BROAD VIEWING ANGLE

(75) Inventors: Chungho Hsia, San Jose, CA (US); Pai-Sheng Shen, Bellevue, WA (US); Ching-Feng Lin, Taipei (TW)

(73) Assignee: Lightel Technologies Inc., Benton, WA (US)

( * ) Notice: Subject to any disclaimer, the term of this patent is extended or adjusted under 35 U.S.C. 154(b) by 457 days.

(21) Appl. No.: 12/690,102

(22) Filed: Jan. 19, 2010

(65) Prior Publication Data

US 2011/0176297 A1 Jul. 21, 2011

(51) Int. Cl.
*F21S 4/00* (2006.01)
*F21V 21/00* (2006.01)

(52) U.S. Cl. ..... 362/217.1; 362/225; 362/218; 362/249.05; 362/295; 362/394

(58) Field of Classification Search ..... 362/217.1, 362/217.11–217.17, 218–225, 373, 249.02, 362/249.05, 249.12, 249.13, 295, 394, 800, 362/802

See application file for complete search history.

(56) References Cited

U.S. PATENT DOCUMENTS

| | | | | |
|---|---|---|---|---|
| 7,049,761 | B2 * | 5/2006 | Timmermans et al. | 315/246 |
| 7,594,738 | B1 * | 9/2009 | Lin et al. | 362/249.02 |
| 7,918,580 | B2 * | 4/2011 | Liu | 362/218 |
| 8,011,805 | B2 * | 9/2011 | Chiang | 362/249.02 |
| 8,047,674 | B2 * | 11/2011 | Liu | 362/218 |
| 8,092,043 | B2 * | 1/2012 | Lin et al. | 362/249.02 |
| 8,147,091 | B2 * | 4/2012 | Hsia et al. | 362/221 |

* cited by examiner

*Primary Examiner* — Bao Q Truong
(74) *Attorney, Agent, or Firm* — Pai Patent & Trademark Law Firm; Chao-Chang David Pai

(57) ABSTRACT

A linear light-emitting diode (LED)-based solid-state device comprising a curved surface to hold a flexible printed circuit board with multiple linear arrays of surface mount LEDs provides lighting applications with a broad viewing angle over 180° along the radial direction. On each of the two lamp bases of the lamp, a shock-protection switch is mounted to prevent shock hazard during re-lamping.

18 Claims, 7 Drawing Sheets

LINEAR SOLID-STATE LIGHTING WITH BROAD VIEWING ANGLE

BACKGROUND OF THE INVENTION

1. Field of the Invention

This invention relates to linear light-emitting diode (LED) lamps and more particularly to a linear LED lamp with a curved surface to provide a broad viewing angle over 180° along the radial direction.

2. Description of the Related Art

Solid-state lighting from semiconductor light-emitting diodes (LEDs) has received much attention in general lighting applications today. Because of its potential for more energy savings, better environmental protection (more eco-friendly, no mercury used, and no UV and infrared light emission), higher efficiency, smaller size, and much longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, the potential safety concerns such as risk of electric shock need to be well addressed.

In many applications of commercial and residential lighting, a linear LED-tube (LLT) lamp is used to replace an existing fluorescent tube, taking advantages of the above said LED's features. In a lighting application of a refrigerated warehouse, an LLT lamp is used to replace a fluorescent lamp because the latter cannot operate at a low temperature of minus 20 degrees Celsius. Use of a high intensity discharge (HID) lamp instead creates much heat and causes the cooling system in the refrigerated warehouse to consume more energy to cool down the refrigerated area. LEDs, however, can operate at minus 40 degrees Celsius, do not generate heat, and thus are well suited for this application. Typical energy savings due to the reduced lighting load are 40%-60% with an additional 12%-19% savings from reduced cooling load.

In high-ceiling lighting applications such as in offices, manufacturing areas, warehouses, showcases in department stores, etc, LLT lamps are used to take advantage of the lowest maintenance cost and the lowest power consumptions and heat dissipations among all kinds of lighting. An LLT lamp can save energy and operating cost by 70%.

A surface mount device (SMD) LED, as a Lambertian emitter, can provide only a beam angle of 120°, in principle. A linear LED tube (LLT) lamp based on surface mount technology inherits this limitation. In some applications such as above mentioned high ceiling areas and refrigerated warehouses, the viewing angle of 180° is required. Some manufacturers, therefore, provide LLT lamps with multiple user-specifiable viewing angles to meet this market demand. They use a variable angle-mounting bracket or rotatable end caps adjusting illumination angle up to 180°. To help install fixtures accurately, they even provide clear bracket featuring angle indicators. Other manufacturers use linear parabolic reflectors and thin-film diffusers to create various beam angles. However, measures such as optics and other means than the present invention can provide only a solution at the expense of extra energy loss due to a limitation of optical efficiency such as transmission, reflection, and absorption loss.

To deal with a wide illumination angle, Timmermans et al. suggests in their patent (U.S. Pat. No. 7,049,761 B2) that a circuit board with an H-shaped cross-section be used. On the horizontal plane of the "H" (horizontal bar in H, extended along the direction to the paper), a plurality of dual-in-line (DIP) LEDs are mounted with different viewing angles against each adjacent one. Because the circuit board that supports LEDs is flat on that plane, the mounting planes for LEDs with different coverage angles must be different to produce an overall predetermined radiation pattern. The DIP LEDs used have a viewing angle between 6° and 45°. For an overall 180° viewing angle, the mounting plane must be between 67.5° and 87° relative to the original plane. One of drawbacks for this design is poor manufacturability, not only in drilling holes at those large oblique angles from the plane normal for mounting DIP LEDs but also in making soldering for each LED connection. Strictly speaking, such drilling at oblique angles between 67.5° and 87° is not manufacturing feasible. Moreover, individual soldering for hundreds of LEDs presents a low-yield, not mentioning inefficiency.

In retrofit application of a linear LED tube (LLT) lamp to replace an existing fluorescent tube, one must remove the starter or ballast because the LLT lamp does not need a high voltage to ionize the gases inside the gas-filled fluorescent tube before sustaining continuous lighting. LLT lamps operating at AC mains, such as 110, 220, and 277VAC, have one construction issue related to product safety and needed to be resolved prior to wide field deployment. This kind of LLT lamps always fails a safety test, which measures through lamp leakage current. Because the line and the neutral of the AC main apply to both opposite ends of the tube when connected, the measurement of current leakage from one end to the other consistently results in a substantial current flow, which may present risk of shock during re-lamping. Due to this potential shock risk to the person who replaces LLT lamps in an existing fluorescent tube fixture, Underwriters Laboratories (UL), use its standard, UL 935, Risk of Shock During Relamping (Through Lamp), to do the current leakage test and to determine if LLT lamps under test meet the consumer safety requirement.

An LLT lamp is at least 2 feet long; it is very difficult for a person to insert the two opposite bi-pins at the two ends of the LLT lamp into the two opposite sockets at two sides of the fixture at the same time. Because protecting consumers from possible electric shock during re-lamping is a high priority for LLT lamp manufacturers, they need to provide a basic protection design strictly meeting the minimum leakage current requirement and to prevent any possible electric shock that users may encounter in actual usage. In other words, when shock hazard happens, the manufacturers have no excuses to claim that they do have proper procedures mentioned in their installation instructions.

Referring to FIG. 1, a conventional LLT lamp 100 comprises a plastic housing 110 with a length much greater than its radius of 30 to 32 mm, two end caps 120 and 130 each with a bi-pin 180 and 190 on two opposite ends of the plastic housing 110, LED arrays 140 and 141 mounted on two PCBs 150 and 151, electrically connected in series using a connector 145, and an LED driver used to generate a proper DC voltage and provide a proper current from the AC main and to supply to the LED arrays 140 and 141 such that the LEDs 170 and 171 on the two PCBs 150 and 151 can emit light. In some conventional LLT lamps, DIP rather than SMD LEDs are used as lighting sources. Although SMD LEDs and the supporting PCB allow more efficient manufacturing, higher yield, higher lumen output and efficacy, and longer life than their DIP counterparts do, some LLT lamp providers still produce such DIP-based products. The two PCBs 150 and 151 are glued on a top plane of the lamp using an adhesive with its normal parallel to the illumination direction. In this case, the viewing angle of the LLT lamp is limited by that of individual LEDs. While SMD LEDs used in the LLT lamp provide a viewing angle less than 120° due to Lambertian emission, a DIP-based LLT lamp offers much less viewing angles.

The bi-pins 180 and 190 on the two end caps 120 and 130 connect electrically to an AC main, either 110 V, 220 V, or 277 VAC through two electrical sockets located lengthways in an existing fluorescent tube fixture. The two sockets in the fixture connect electrically to the line and the neutral wire of the AC main, respectively. The LLT lamp 100 may present electric shock hazard when one of the bi-pins 180 or 190 is first inserted into the socket that connects to the line of AC main. The energized LED driver causes a lamp leakage current flowing through the exposed bi-pin 190 or 180 not in the socket, and thus presents risk of shock during re-lamping.

FIG. 2 is an illustration of another conventional LLT lamp, claiming to have a wider viewing angle. The LLT lamp 1000 comprises a plastic housing 1100 as bulb portion, and an "H" shape circuit board 1200. On the horizontal plane 1300 of "H" is DIP LEDs 1301 mounted. DIP LEDs 1401 and 1501 are mounted on different planes 1400 and 1500, respectively (shown in FIG. 3). No end caps with bi-pin are shown in FIG. 2 for clarity. FIG. 3 is a cross-sectional view of FIG. 2. The LED array 1301 is mounted on the plane 1300 while LED arrays 1401 and 1501 are mounted on the plane 1400 and 1500, respectively, each with their own radiation patterns. In combination, the overall beam has a wider viewing angle in the radial direction than the individual beam does. As mentioned, when the planes 1400 and 1500 incline at large angles to achieve an 180° viewing angle for the overall beam emitted from DIP LEDs, the hole drilling at such oblique angles as 67.5° and 87° relative to the original plane 1300 becomes manufacturing infeasible. As can be seen, the beam angle is far from 180°, partly because the two vertical planes 1600 and 1601 of "H" block part of the beam. DIP rather than SMD LEDs used are another reason that the beam cannot radiate that wide due to the limitation of narrow viewing angle of DIP LEDs.

SUMMARY OF THE INVENTION

A conventional linear surface mount device (SMD) LED-based lamp can provide only a beam angle of 120° due to a limitation of Lambertian emitters. In many lighting applications, a wider beam angle in LLT radial direction is required. The present invention then provides a linear light-emitting diode (LED)-based solid-state device comprising a curved surface to hold a flexible printed circuit board (PCB) with multiple linear arrays of SMD LEDs for lighting applications of an 180° beam angle. The printed circuit board used is thin and flexible enough such that it can be tightly attached and glued on the curved surface. Each linear LED array on the PCB can then emit light at an angle determined by the radius of the curved surface and the distance between the LED array and the central line of the LED PCB along the length. In superposition, the LLT lamp can offer a beam angle over 180° along the radial direction, suited for wide-angle applications. The approach provides a means for mass production and eliminates any extra energy loss associated with limitations of optical efficiency such as transmission, reflection, and absorption loss of optics.

Such LLT lamps can be used in such applications as high ceiling offices, store showcases, warehouses, task lighting for cabinets, kitchen closets, kitchens, small coves, and in indirect lighting applications or any other places where accent lighting is required. Other applications such as back lighting for square billboards or advertisement boards are also possible.

To protect consumers from possible electric shock during re-lamping, the present invention provides two special lamp bases, one for each end of the LLT lamp. Each lamp base contains a standard bi-pin and at least one shock protection switch, both mounted on a lamp base PCB, rather than on an end cover. This structure is different from that of the conventional LLT lamp, which uses two end caps in which the bi-pins are directly mounted.

DETAILED DESCRIPTION OF THE INVENTION

Figure 1:
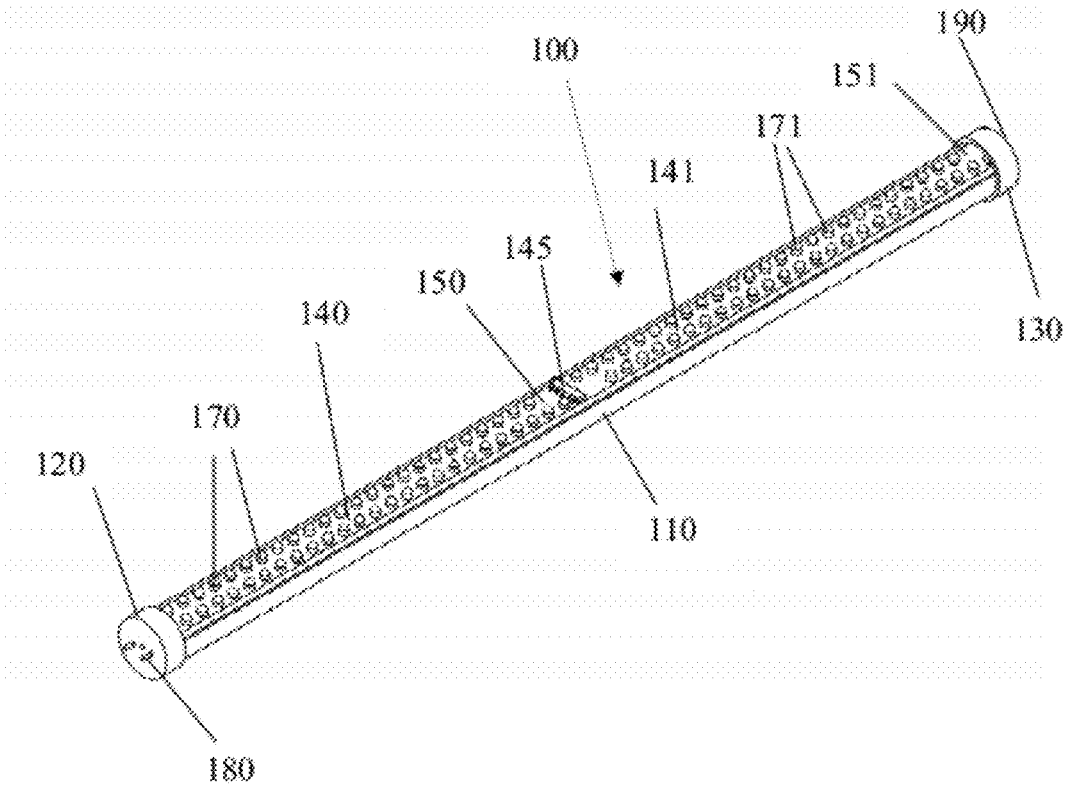
FIG. 1 PRIOR ART
FIG. 1 is an illustration of a conventional LLT lamp.
Figure 2:
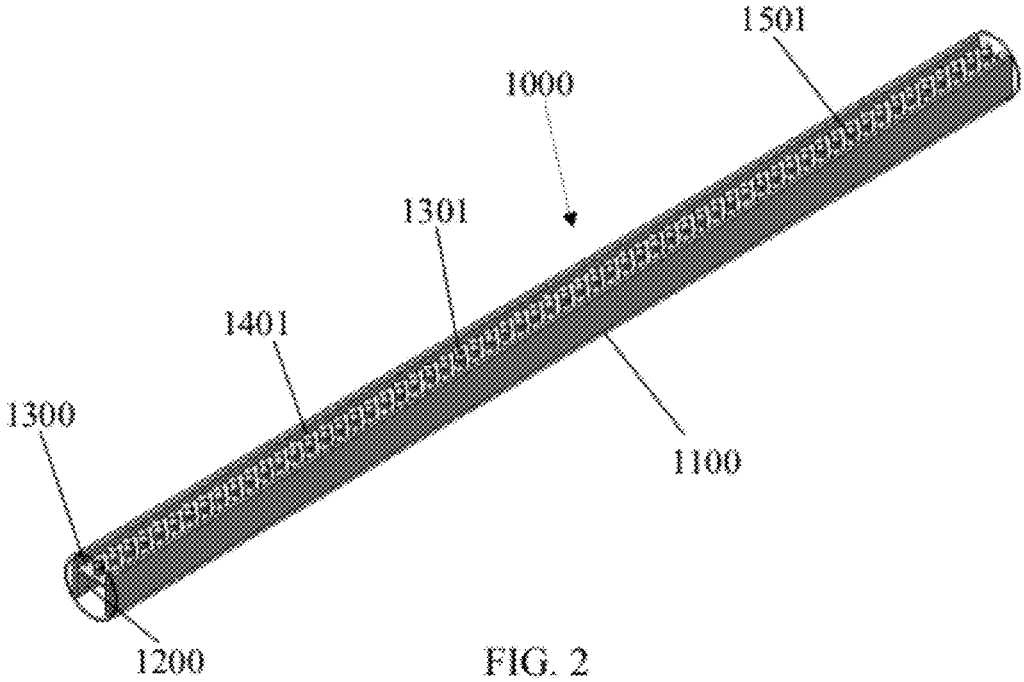
FIG. 2 PRIOR ART
FIG. 2 is an illustration of another conventional LLT lamp.
Figure 3:
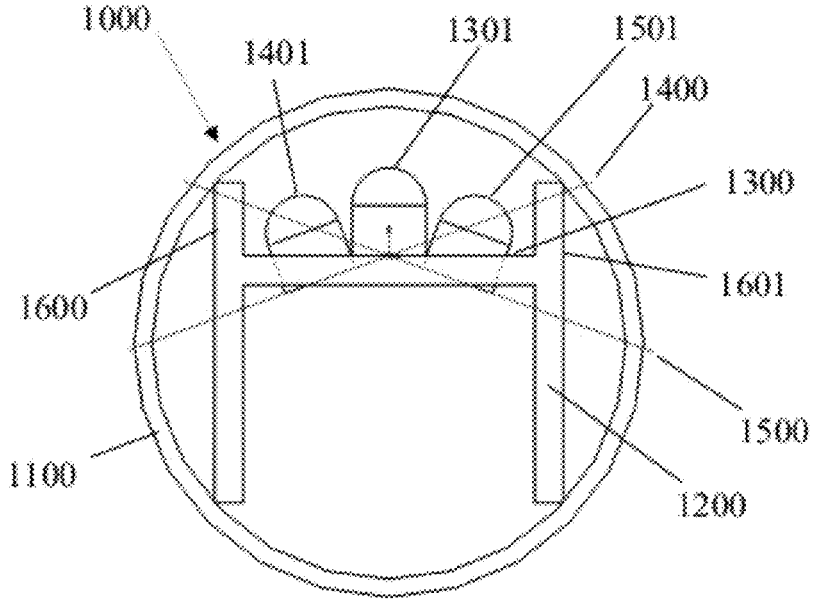
FIG. 3 PRIOR ART
FIG. 3 is a cross-sectional view of the LLT lamp in FIG. 2.
Figure 4:
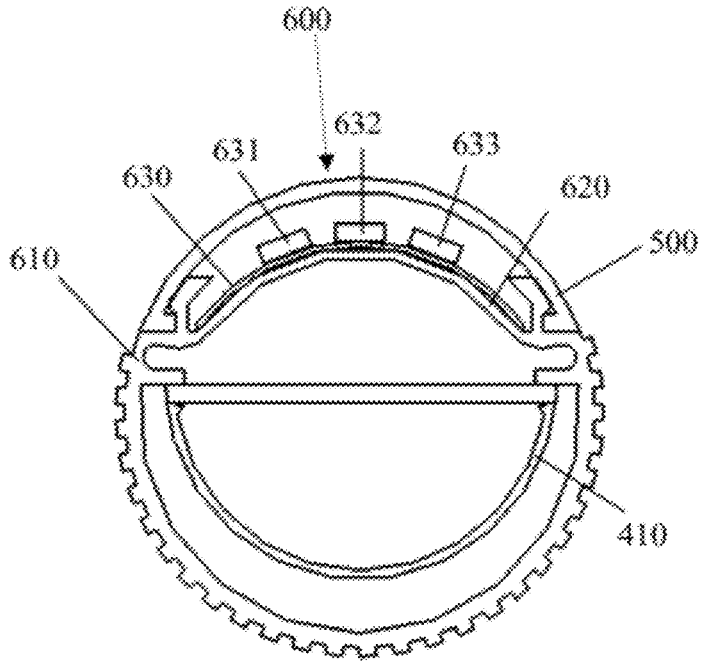
FIG. 4 is a cross-sectional view of the LLT lamp according to the present invention when the LED driver, the lamp base, and associated shock protection switches are omitted.

FIG. 4 is a cross-sectional view of the LLT lamp according to the present invention when the LED driver, the lamp base, and associated shock protection switches are omitted. The LLT lamp 600 has a housing 610 with a curved surface 620 on the top. The housing 610, preferably metallic in material, serves also as a heat sink with a toothed profile to increase the heat dispersion. Other types of projections can be formed on the outer surface of the housing for improved heat dispersion. On the top of the curved surface 620 is a thin and flexible single-piece LED PCB 630 curved to fit closely to the surface 620. The LED PCB 630 electrically and mechanically supports the SMD LEDs 631, 632, and 633, arranged in arrays. Because the LED PCB 630 follows the curvature of the surface 620 when it tightly fits on the surface 620, the SMD LEDs 631, 632, and 633 on the LED PCB 630 then have different normal directions relative to the tangential planes at their positions. Supposed that the angle subtended between the normal direction of LED 631 and of LED 632 is 30°. Similarly, supposed that the angle subtended between the normal direction of LED 633 and of LED 632 is also 30°. While SMD LEDs have a half viewing angle of 60°, the overall light emission pattern from LEDs 631, 632, and 633 covers the entire 180° in the radial direction. In the light emission direction, a lens 500 is used to further regulate the light emission pattern and to protect the LEDs from accidental damage. In the hollow space below the curved surface is a driver enclosure 410 for holding an LED driver that powers the LEDs 631, 632, and 633. Although a metallic housing 610 is preferred for more effectively dispersing heat, the present invention is not limited to one having a metallic housing. Namely, the LLT lamp in the present invention may have a non-metallic housing.

Figure 5:
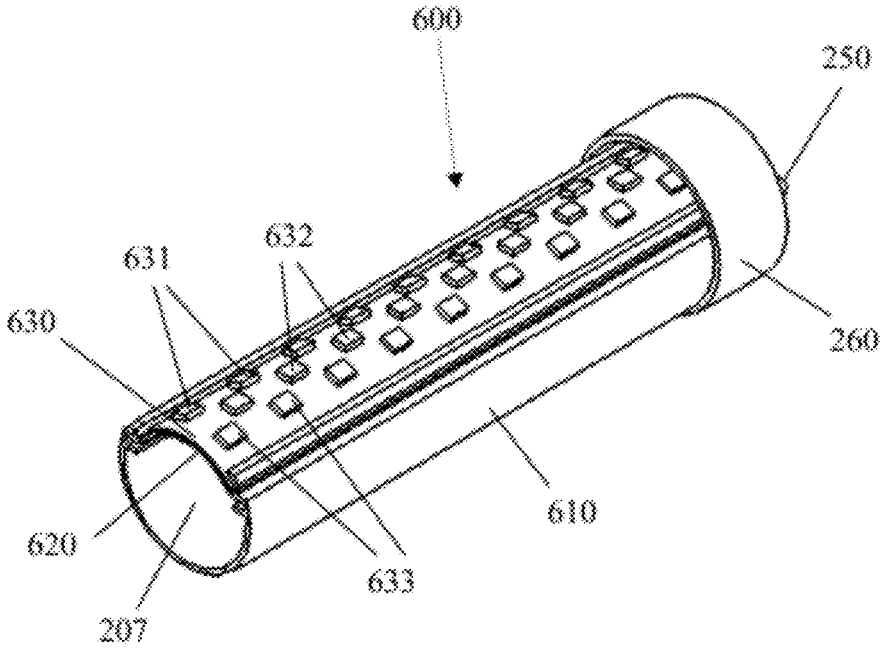
FIG. 5 is a perspective view of an LLT lamp according to the present invention.

FIG. 5 is a perspective view of an LLT lamp according to the present invention. The lamp comprises two lamp bases 260 (only one shown for clarity), one at each end of the housing 610 and each having a shock protection switch and a bi-pin 250, LEDs 631, 632, and 633, an LED driver (not shown) inserted into the driver enclosure 410 (not shown in FIG. 5), which is inserted into the hollow space 207, and a lens 500 (not shown for clarity). On top of the housing 610 is the curved surface 620 on which a curved LED PCB 630 that follows closely the curvature of the curved surface 620 is mounted.

Figure 6:
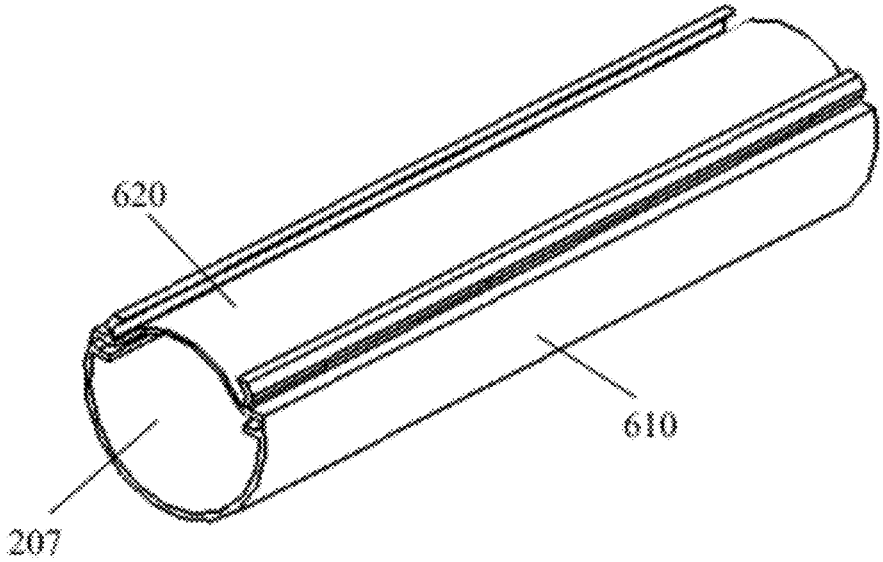
FIG. 6 is an illustration of a curved surface on top of the LLT housing according to the present invention.

FIG. 6 is illustrates the curved surface 620 of the LLT housing according to the present invention. On top of the housing 610 is the curved surface 620, below which a hollow space 207 is shown.

Figure 7:
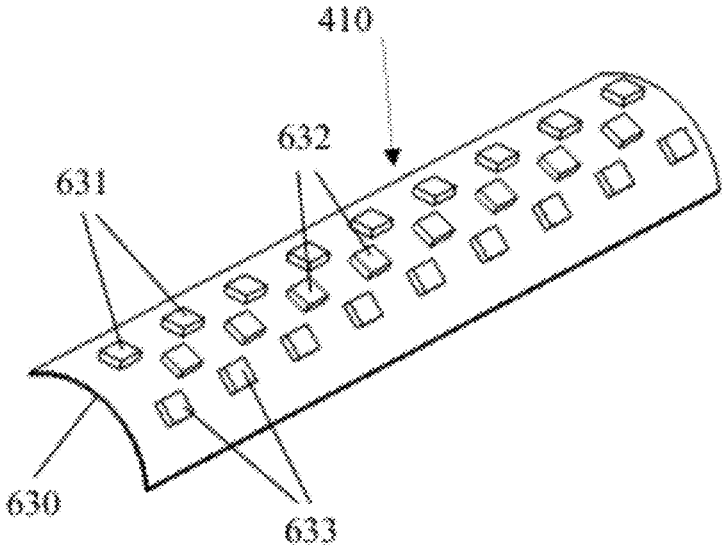
FIG. 7 is an illustration of a LED PCB curved to fit the curved surface of the housing according to the present invention.
Figure 8:
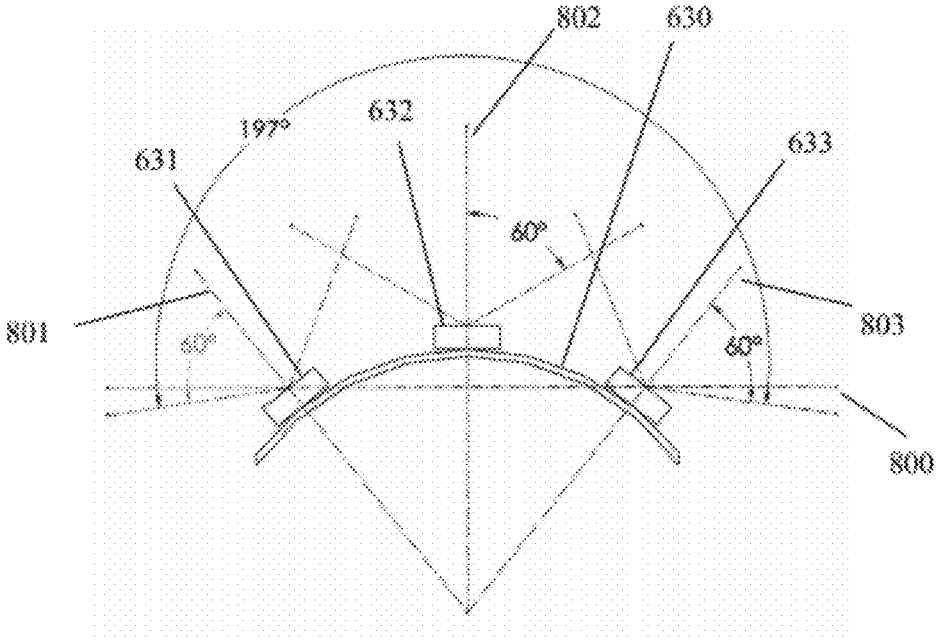
FIG. 8 is an illustration of an embodiment with a 197° viewing angle according to the present invention.

FIG. 7 is an illustration of a LED PCB curved to fit the curved surface of the housing. The LED PCB 630 is thin and flexible enough such that when it is attached to the curved surface 620, it can follow the curvature of the surface 620. Thus, each SMD LEDs 631, 632, and 633 can emit light from a tangential plane at its position. In superposition, the LLT lamp offers an 180° beam angle along the radial direction, thus suitable for wide-angle applications. The SMD LEDs 631, 632, and 633 can first be mass-soldered on the PCB 630, taking advantage of surface mount technology. Then the PCB is attached and fixed on the curved surface 620 on the housing 610 such that it follows the curvature of the surface 620. FIG. 8 is an illustration of a 197° viewing angle according to the present invention. The subtended angle between the normal direction 801 of LED 631 and the normal direction 802 of LED 632 is determined by the radius of curvature of the curved surface 620 and the distance between LED 631 and LED 632. Similarly, the subtended angle between the normal direction 803 of LED 633 and the normal direction 802 of LED 632 is determined by radius of curvature of the curved surface 620 and the distance between LED 633 and LED 632. In FIG. 8, SMD LED arrays 631, 632, and 633 have their individual half-viewing angle of 60°. In combination, the overall viewing angle reaches 197°. The LED PCB can be replaced by a semiconductor substrate with multiple LED chips built directly on the substrate—a process widely used to produce integrated circuit based on large-scale-integration (LSI) technology in semiconductor industry. Because no optics or other means than the curved surface that defines the emission pattern, the approach eliminates extra energy loss associated with limitations of optical efficiency such as transmission, reflection, and absorption loss of optics.

Figure 9:
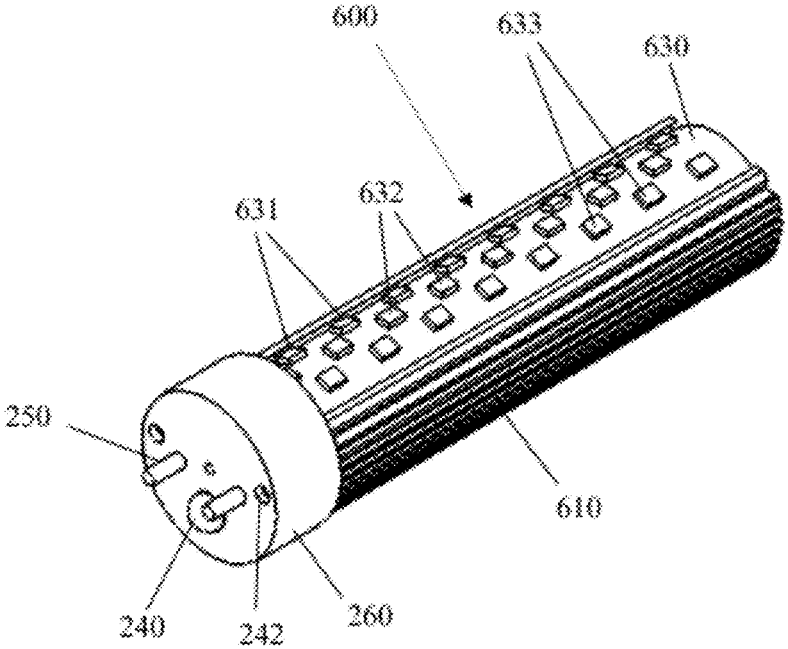
FIG. 9 is an illustration of an LLT lamp with shock protection switches according to the present invention.
Figure 10:
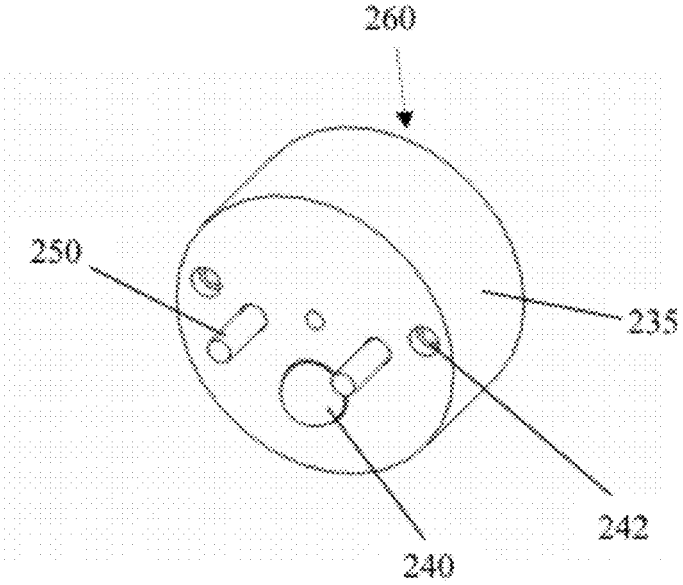
FIG. 10 is an illustration of a lamp base with a shock protection switch in place according to the present invention.
Figure 11:
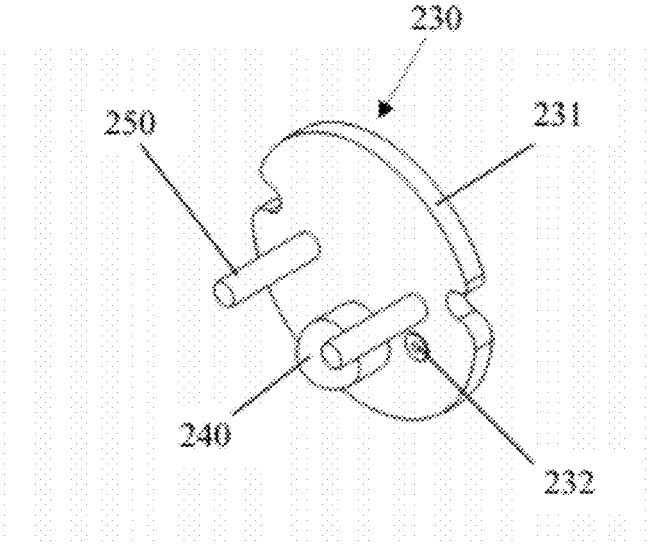
FIG. 11 is an illustration of a lamp base PCB assembly for the LLT lamp according to the present invention.
Figure 12:
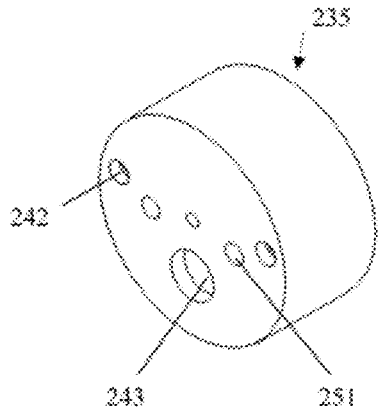
FIG. 12 is an illustration of an end cover for the LLT lamp according to the present invention.

The present invention uses also a shock-protection switch design on the two lamp bases to prevent electric shock from happening during re-lamping. FIG. 9 is an illustration of an LLT lamp with a shock protection switch according to the present invention, with only one lamp base 260 shown. The relative positions of lamp bases 260, a protection switch mechanism, and the lamp housing 610 are shown in FIG. 9, with more details given in FIGS. 10, 11 and 12. FIG. 10 is an illustration of the lamp base 260, which comprises a lamp base PCB assembly 230 (FIG. 11) and an end cover 235 (FIG. 12). In FIG. 10, the lamp base PCB assembly 230 further comprises a standard bi-pin 250 and one shock protection switch with actuation mechanism 240, mounted on a PCB 231. The PCB 231 has etched conductors in two layers. One layer is used to connect between the two pins of the bi-pin 250. The other one is used to connect one of the two electrical contacts of the protection switch to the bi-pin 250 through the soldering point 232 using a wire connection. FIG. 12 is an illustration of the end cover 235 for holding and fixing the lamp base PCB assembly 230 on an end of the LLT lamp 600. When the lamp base 260 is fixed on the housing 610 through two counter-bore screw holes 242, the bi-pin 250 and the switch actuation mechanism 240 will protrude from the holes 251 and 243, respectively. The lamp base 260 uses the bi-pin 250 to connect the AC mains to the LED driver through the protection switch, normally in "off" state. When pressed, the actuation mechanism 240 actuates the switch and turns on the connection between the AC mains and the LED driver.

Figure 13:
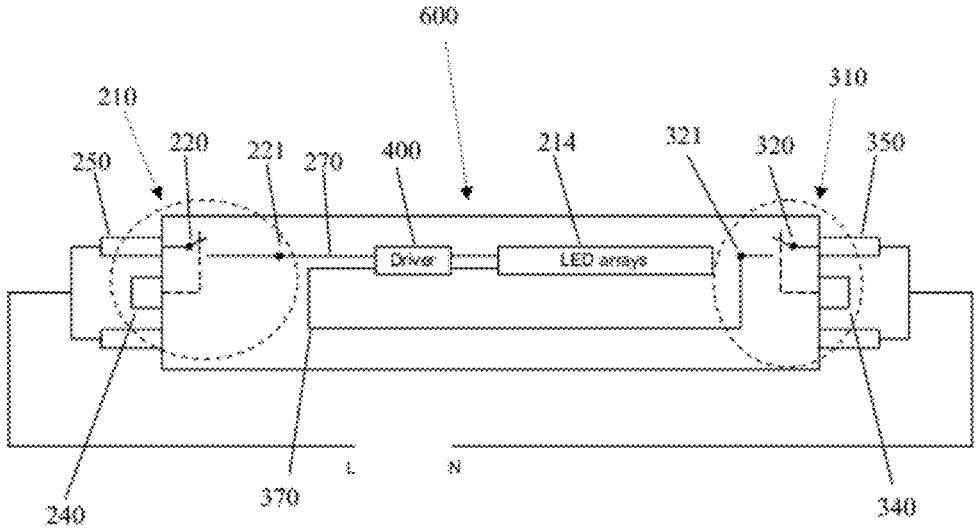
FIG. 13 is a block diagram of an LLT lamp with shock protection switches according to the present invention.

FIG. 13 is a block diagram of an LLT lamp 600 with protection switches 210/310 in the present invention. As shown, the LED driver 400 and the LED arrays 214 are individual modules. The modular design allows LLT lamps 600 to be produced more effectively while more numbers of LEDs can be surface-mounted in the LED PCB 630 area that electronic components of the LED driver may otherwise occupy. The lamp using this design can provide a sufficiently high lumen output, thus improving the system efficacy required by Energy Star program. The shock protection switch 210 (as dash circle) comprises two electrical contacts 220 and 221 and one actuation mechanism 240. Similarly, a shock protection switch 310 (as dash circle) comprises two electrical contacts 320 and 321 and one actuation mechanism 340.

The shock protection switch can be of a contact type (such as a snap switch, a push-button switch, or a micro switch) or of a non-contact type (such as electro-mechanical, magnetic, optical, electro-optic, fiber-optic, infrared, or wireless based). The proximity control or sensing range of the non-contact type protection switch is normally up to 8 mm.

Referring to FIG. 13, one of the contacts 220 connects electrically to the bi-pin 250 in the lamp base 260 that connects to AC mains, and the other contact 221 connects to one of the inputs 270 of the LED driver 400. One of the contacts 320 connects electrically to the bi-pin 350 in the lamp base 360 that connects to AC mains, and the other contact 321 connects to the other input 370 of the LED driver 400. The switch is normally off. Only after actuated, will the switch turn "on" such that it connects the AC mains to the LED driver 400 that in turn powers the LED arrays 214. Served as gate controllers between the AC mains and the LED driver 400, the protection switch 210 and 310 connect the line and the neutral of the AC mains to the two inputs 270 and 370 of the driver 400, respectively. The protection switch may have direct actuation or sensing mechanism that actuates the switch function.

Referring to FIGS. 9 and 13, if only one shock protection switch 210 is used at one lamp base 260 for one end of the LLT lamp 200, and if the bi-pin 250 of this end happens to be first inserted into the live socket at one end of the fixture, then a shock hazard occurs because the shock protection switch 210 already allows the AC power to connect to the driver 400 electrically inside the LLT lamp when the bi-pin 250 is in the socket. Although the LLT lamp 600 is deactivated at the time, the LED driver 400 is live. Without the shock protection switch 310 at the other end of the LLT lamp 200, the driver input 370 connects directly to the bi-pin 350 at the other end of the LLT lamp 200. This presents a shock hazard. However, if the shock protection switch 310 is used as in accordance with this application, the current flow to the earth continues to be interrupted until the bi-pin 350 is inserted into the other socket, and the protection switch 310 is actuated. The switch redundancy eliminates the possibility of shock hazard for a person who installs an LLT lamp in the existing fluorescent tube fixture.

What is claimed is:

1. A linear light-emitting diode (LED) tube lamp, comprising:

a housing having two ends and a curved surface on a top side thereof between the two ends;

a light-emitting diode printed circuit board (LED PCB) which is curved to closely fit the curved surface and is fixed on the curved surface, the LED PCB having a plurality of LEDs fixed thereon;

an LED driver that powers the plurality of LEDs on the LED PCB, wherein the LED driver has two inputs and is fixed inside the housing below the curved surface; and two lamp bases respectively connected to the two ends of the housing, each lamp base having an end cover and a lamp base PCB assembly comprising a bi-pin with two pins protruding outwards through the end cover, a lamp base PCB, and a shock protection switch mounted on the lamp base PCB, wherein: when the shock protection switch is off, the bi-pin is not electrically connected with the LED driver; when the bi-pin is inserted into a lamp socket, the shock protection switch is actuated to electrically connect the bi-pin with one of the inputs of the LED driver.

2. The linear LED tube lamp of claim 1, wherein the shock protection switch of each of the lamp bases comprises:

at least two electrical contacts, one electrically connected to the bi-pin of the lamp base and the other electrically connected to one of the inputs of the LED driver; and at least one switch actuation mechanism having a front portion protruding outwards through the end cover of the lamp base, wherein when the front portion of the switch actuation mechanism is pressed in by inserting the bi-pin of the lamp base into a lamp socket, the two electrical contacts are electrically connected to actuate the shock protection switch so that the bi-pin is electrically connected with one of the inputs of the LED driver.

3. The linear LED tube lamp of claim 1, wherein the LEDs include white, red, green, blue LEDs or a combination thereof.

4. The linear LED tube lamp of claim 1, wherein the LED driver is enclosed in a driver enclosure fixed inside the housing below the curved surface.

5. The linear LED tube lamp of claim 1, wherein the shock protection switch is of a contact type.

6. The linear LED tube lamp of claim 5, wherein the shock protection switch is a snap switch, a push-button switch, or a micro switch.

7. The linear LED tube lamp of claim 1, wherein the shock protection switch is of a non-contact type.

8. The linear LED tube lamp of claim 7, wherein the shock protection switch is electro-mechanical, magnetic, optical, electro-optic, fiber-optic, infrared, or wireless based.

9. The linear LED tube lamp of claim 8, wherein the shock protection switch has a proximity control or sensing range up to 8 mm.

10. The linear LED tube lamp of claim 1, wherein the end cover is fixed to the associated lamp base PCB assembly by screws.

11. The linear LED tube lamp of claim 1, wherein the LED PCB is flexible and is fixed on the curved surface by screws, rivets, or adhesives.

12. The linear LED tube lamp of claim 1, wherein the LEDs are surface mount device (SMD) LEDs or dual in-line package (DIP) LEDs.

13. The linear LED tube lamp of claim 1, wherein the LED PCB is a semiconductor substrate, and the plurality of LEDs are LED chips built directly on the substrate.

14. The linear LED tube lamp of claim 1, wherein the LEDs are arranged in at least three linear arrays lengthways, each defining an individual emission pattern.

15. The linear LED tube lamp of claim 1, further comprising a lens covering the LED PCB and the LEDs.

16. The linear LED tube lamp of claim 1, wherein a plurality of projections are formed on an outer surface of the housing for improved heat dispersion.

17. The linear LED tube lamp of claim 1, wherein the housing has a cross section with a circumference composed of two circular curves, one corresponding to the housing and the other corresponding to the curved surface.

18. The linear LED tube lamp of claim 1, further comprising a lens covering the LED PCB and the LEDs, wherein the lens and the housing have a combined cross section with a full-circle circumference.

* * * * *